US012729045B2

(12) United States Patent
Strassburger

(10) Patent No.: US 12,729,045 B2
(45) Date of Patent: Sep. 8, 2026

(54) DISPLAY HANGER ASSEMBLY FOR DISPLAYING AND HANGING A CONSUMER PRODUCT

(71) Applicant: B&G International Products Ltd., Kowloon (HK)

(72) Inventor: Jacob Strassburger, South Plainfield, NJ (US)

(73) Assignee: B&G International Products Ltd., Kowloon (HK)

( * ) Notice: Subject to any disclaimer, the term of this patent is extended or adjusted under 35 U.S.C. 154(b) by 0 days.

(21) Appl. No.: 18/664,580

(22) Filed: May 15, 2024

(65) Prior Publication Data

US 2024/0425255 A1 Dec. 26, 2024

Related U.S. Application Data

(60) Provisional application No. 63/523,143, filed on Jun. 26, 2023.

(51) Int. Cl.

| | |
|---|---|
| ***B65D 73/00*** | (2006.01) |
| *A47F 7/02* | (2006.01) |
| *A47G 25/00* | (2006.01) |
| *A47G 25/06* | (2006.01) |

(52) U.S. Cl.

CPC ..... *B65D 73/0064* (2013.01); *A47F 7/021* (2013.01); *A47G 25/005* (2013.01); *A47G 25/0607* (2013.01)

(58) Field of Classification Search

CPC ..... B65D 73/0064; B65D 73/00; A47F 7/021; A47G 25/005; A47G 25/0607

See application file for complete search history.

(56) References Cited

U.S. PATENT DOCUMENTS

| | | | | |
|---|---|---|---|---|
| 4,063,669 | A | 12/1977 | Smilow et al. | |
| 4,337,539 | A * | 7/1982 | Najarian | A41D 25/12 2/153 |
| 4,739,883 | A * | 4/1988 | Mohs | B65D 73/00 206/467 |
| 4,768,649 | A * | 9/1988 | Kolton | A47G 25/743 211/113 |
| 5,005,741 | A | 4/1991 | Kolton et al. | |
| 5,090,570 | A * | 2/1992 | Todd | B65D 75/22 206/463 |
| 5,222,638 | A | 6/1993 | Kolton et al. | |
| 5,240,123 | A | 8/1993 | Hawk | |
| 5,261,580 | A * | 11/1993 | Smith | A47G 25/483 223/DIG. 2 |
| 5,279,420 | A * | 1/1994 | Rodgers | B65D 73/0064 40/668 |
| 5,437,172 | A | 8/1995 | Lamy et al. | |

(Continued)

*Primary Examiner* — Nkeisha Smith

(74) *Attorney, Agent, or Firm* — Hoffmann & Baron, LLP

(57) ABSTRACT

A display hanger assembly is used to hang and display a variety of consumer products in a retail setting. The assembly includes a hook element for hanging from a display rack peg and an integrally molded consumer product attachment assembly. The attachment assembly includes product support member and hook element attachment member. The attachment member includes a first interconnecting portion and a second interconnecting portion which are detachably connected for securement to the hook element.

10 Claims, 5 Drawing Sheets

(56) References Cited

U.S. PATENT DOCUMENTS 5,505,351 A * 4/1996 Najarian ..... B65D 73/0064 223/DIG. 2
5,556,014 A * 9/1996 Kolton ..... A47G 25/743 206/292
5,626,268 A 5/1997 Kolton et al.
5,627,520 A 5/1997 Grubbs et al.
5,826,760 A * 10/1998 Kolton ..... B65D 73/0064 223/87
5,969,613 A 10/1999 Yeager et al.
6,105,833 A * 8/2000 Najarian ..... A47G 25/743 223/82
6,264,077 B1 7/2001 Kolton et al.
6,283,312 B1 * 9/2001 Edgerton ..... B65D 5/46024 211/113
6,299,039 B1 10/2001 Hsu
6,497,347 B1 * 12/2002 Feibelman ..... A47G 25/743 223/87
6,595,355 B1 7/2003 Hooper
D492,215 S 6/2004 Lu
7,015,815 B1 3/2006 Feibelman
7,448,520 B2 11/2008 Kolton et al.
7,456,741 B2 11/2008 Norman et al.
8,308,291 B2 * 11/2012 Norman ..... A47F 7/0243 351/158
8,590,699 B2 * 11/2013 Feibelman ..... E05B 73/0064 70/14
8,651,344 B2 2/2014 Norman et al.
9,265,361 B1 * 2/2016 Streich ..... B65B 61/14
9,480,347 B2 11/2016 Strassburger
9,585,496 B2 3/2017 Strassburger et al.
9,975,682 B2 5/2018 Strassburger et al.
10,413,095 B2 * 9/2019 Strassburger ..... A47F 5/0006
10,905,269 B2 * 2/2021 Johansson ..... A47G 25/32
11,142,930 B2 * 10/2021 Strassburger ..... A47F 5/0006
11,160,406 B2 11/2021 Strassburger
2004/0217249 A1 11/2004 Eisenbraun
2010/0084353 A1 4/2010 Barker et al.
2012/0061336 A1 3/2012 Norman et al.
2013/0015215 A1 1/2013 Coote
2014/0075725 A1 3/2014 Feibelman et al.
2016/0058209 A1 * 3/2016 Strassburger ..... A47F 5/0006 248/317
2019/0075945 A1 3/2019 Strassburger et al.
2022/0406156 A1 * 12/2022 Napthine ..... E05B 73/0017

* cited by examiner

DISPLAY HANGER ASSEMBLY FOR DISPLAYING AND HANGING A CONSUMER PRODUCT

CROSS-REFERENCE TO RELATED APPLICATION

This application claims priority to U.S. Provisional Patent Application No. 63/523,143, filed on Jun. 26, 2023, the contents of which are incorporated herein by reference in its entirety.

FIELD OF THE INVENTION

The present invention relates to hangers that are used for displaying and hanging a variety of consumer products in a retail setting. More particularly, the present invention relates to hangers which can be hung from a display rack peg and can support various consumer products.

BACKGROUND OF THE INVENTION

Consumer products are commonly displayed for sale in a retail environment on display racks where the consumer products may be hung. A variety of different hangers have been used which secure different consumer products. These hangers employ a hook-like device at one end for hanging from the peg of the display rack.

In designing these display hangers, several factors must be addressed. These factors include the cost of manufacturing the hanger, the cost and ease of attaching the hanger to the display rack and the securement of the hanger to the consumer product. This is particularly important where there is a need to display and attach different types of consumer products. In each case, the hanger must be easily attached to the rack by the merchant and must also be easily removed by the consumer.

Most hangers of these types are specifically designed to hang one type of consumer product from the display rack. For example, U.S. Pat. No. 8,651,344 shows a display hanger for hanging and displaying flip flops. U.S. Pat. No. 9,585,496 describes a display hanger specifically constructed for displaying and hanging jewelry. In each case, while the display hanger functions adequately to support its intended consumer product, a separately manufactured complete hanger must be provided for each consumer product.

SUMMARY OF THE INVENTION

In accordance with the present invention, a display hanger assembly for displaying and hanging consumer products from a display rack is provided.

The display hanger includes a hook element for hanging from a display rack peg. An integrally molded product attachment assembly includes a product supporting member for supporting the consumer product at one end and a hook element attachment member for attaching the product attachment assembly to the hook element. The hook element attachment member includes a first interconnecting portion which is detachable from a second interconnecting portion so that the first and second interconnecting portions can be secured together about the hook element for securing the product attachment assembly to the hook element.

DETAILED DESCRIPTION OF THE PRESENT EMBODIMENT

Figure 1A:
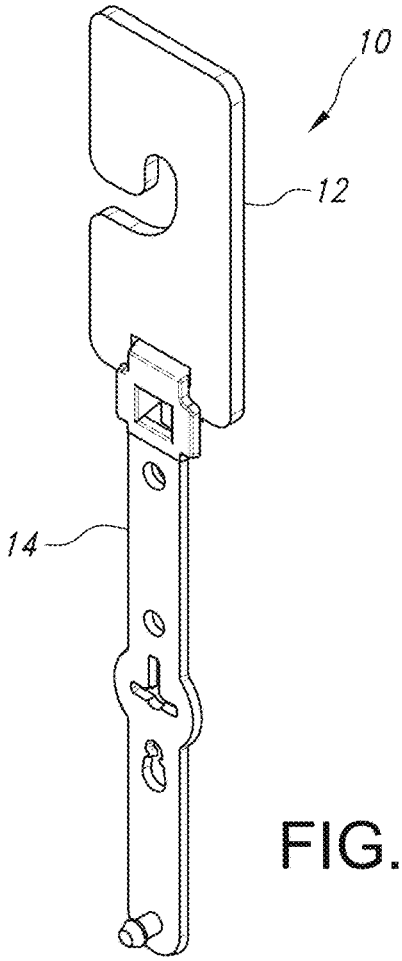
FIGS. 1A-1G show various embodiments of the display hanger assembly of the present invention, including a hook element and an integrally molded product attachment assembly.

The present is directed to a display hanger assembly 10 which is used for hanging and displaying a variety of consumer products in a retail environment. The assembly 10 includes a hook element 12 for hanging the assembly 10 from a retail display rack peg and an integrally molded product attachment assembly 14 which supports a different embodiment, a variety of consumer products.

As shown in the drawings herein, FIGS. 1A-1G show hook element 12 with differing product attachment assemblies 14. Each of the product attachment assemblies 14 of the various figures may be used to support a different consumer product (not shown).

FIG. 1A is used as a belt hanger to hang a belt from a display rack.

Figure 1B:
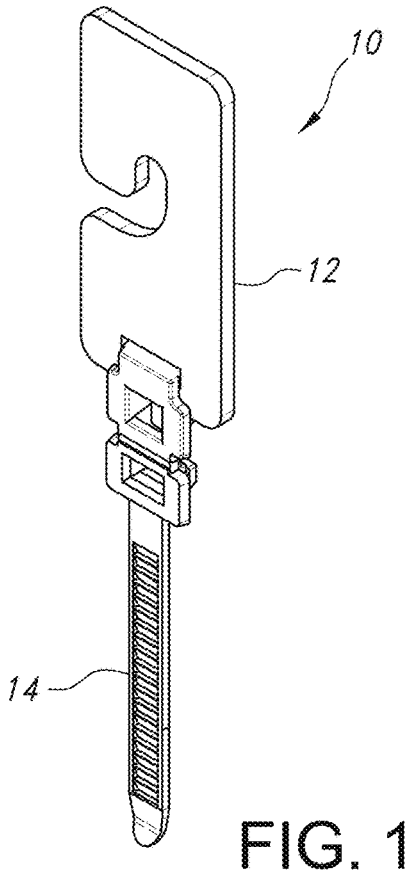

FIG. 1B is an eyeglass or sunglass hanger. The strap wraps around the nose of the bridge part of the glasses.

Figure 1C:
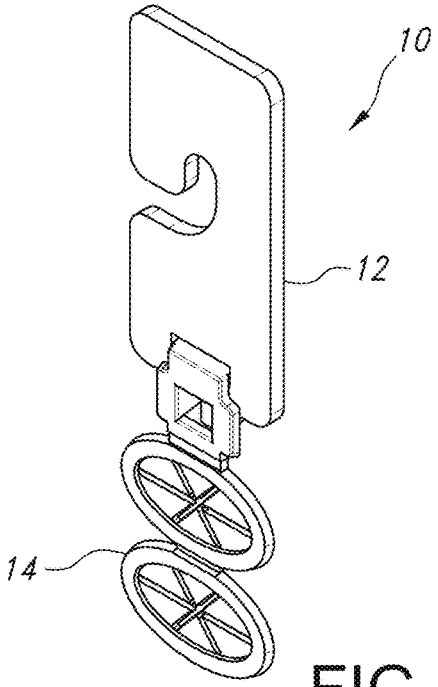

FIG. 1C also is used as an eyeglass or sunglass hanger. The arm of the glasses are inserted into the two loops consecutively. The fingers in the oval loop center the glasses on the hanger.

Figure 1D:
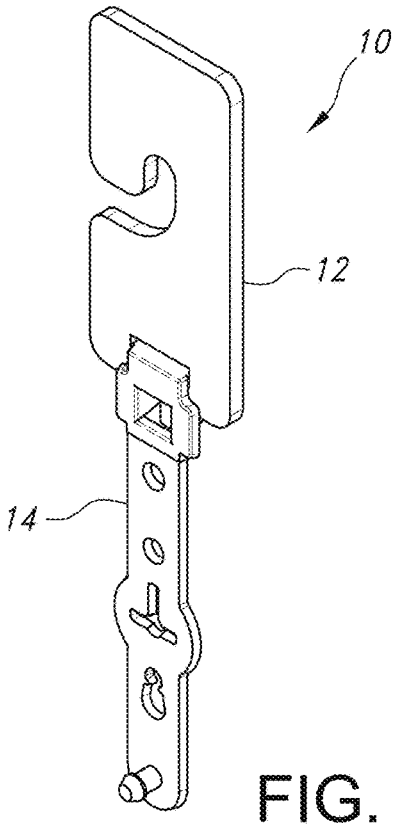

FIG. 1D is also a belt hanger.

Figure 1E:
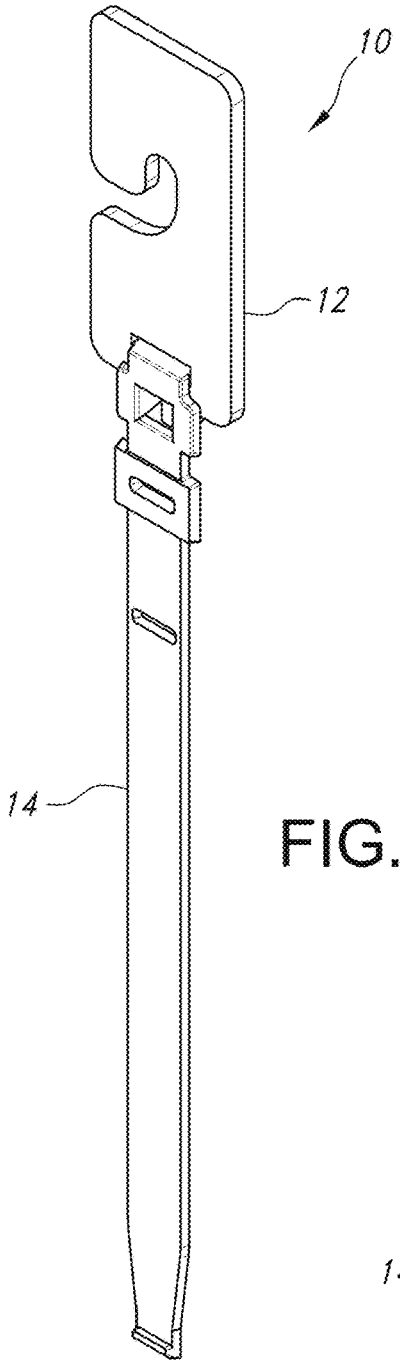

FIG. 1E shows a bulky item hanger such as a scarf or sweatpants.

Figure 1F:
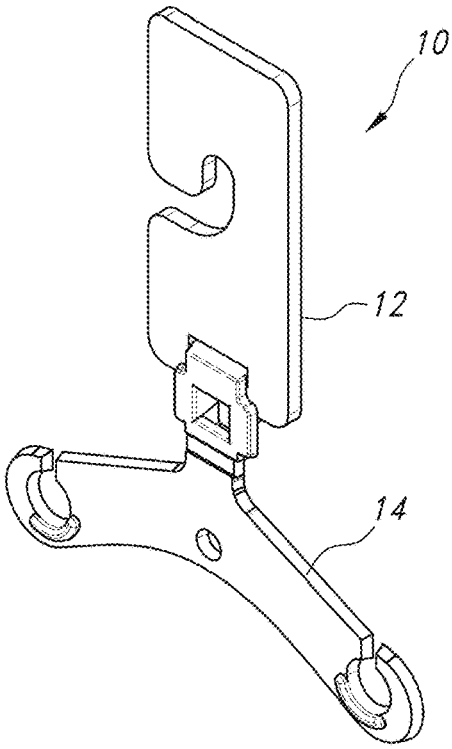

FIG. 1F is used to hang shoes such as a sneaker or thong. The toe post of the thong is placed in the two slots. Shoes and sneakers, which include heal loops, place the heal loop in the slots. A bungee cord (not shown) is laced through the items and hole in the hanger to keep the hanger with the shoes while the customer tries on the shoes.

Figure 1G:
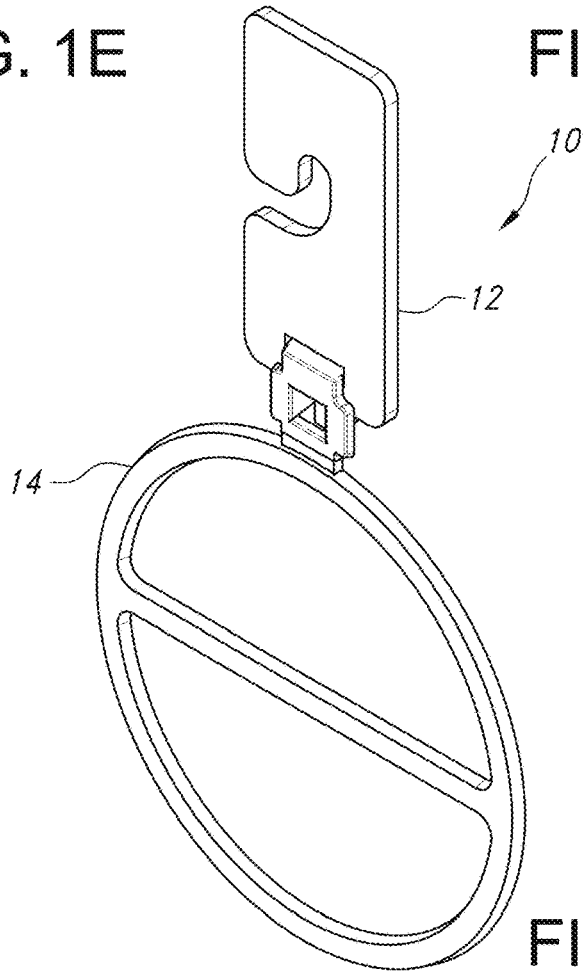

FIG. 1G shoes another scarf hanger.

The present invention allows an identical hook element 12 to be used with various attachment assemblies 14 where the attachment assemblies may be secured to the hook element 12 in an identical manner but still allow securement of different consumer products.

Figure 2A:
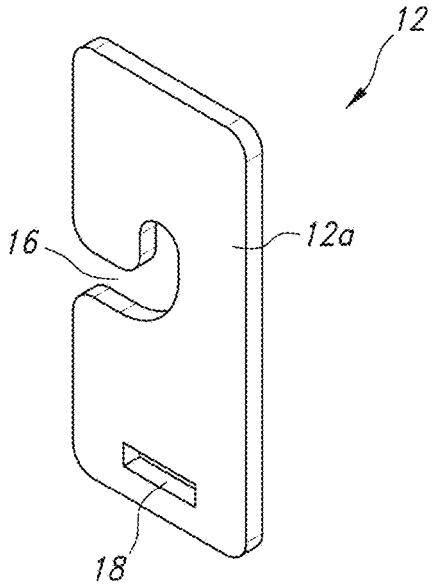
FIGS. 2A and 2B show the hook element of the hanger assembly of FIG. 1.
Figure 2B:
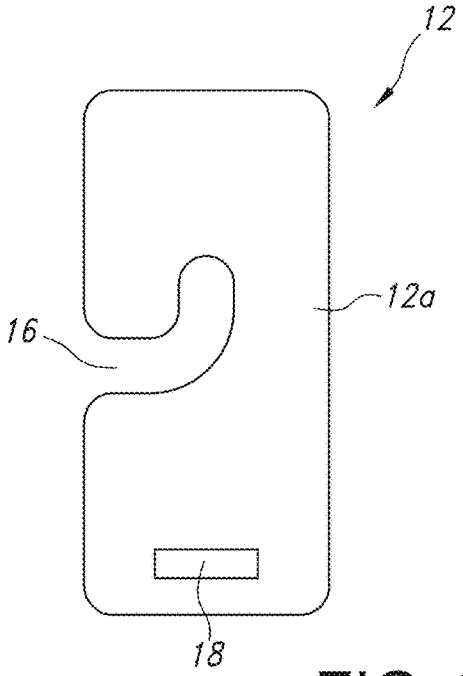

Referring to FIGS. 2A and 2B, the hook element 12 is shown. The hook element 12 has a planar body 12*a* which may be formed of a wide variety of materials. In the present embodiment the hook element is formed of paperboard. The body 12*a* has a hook-shaped passageway 16 extending inwardly from one side thereof which defines the hook which allows the hook element 12 to be hung from a display peg (not shown). At the lower end of body 12*a* is a rectangular opening 18 extending therethrough. The purpose of the rectangular opening 18 will described in further detail hereinbelow.

Figure 3A:
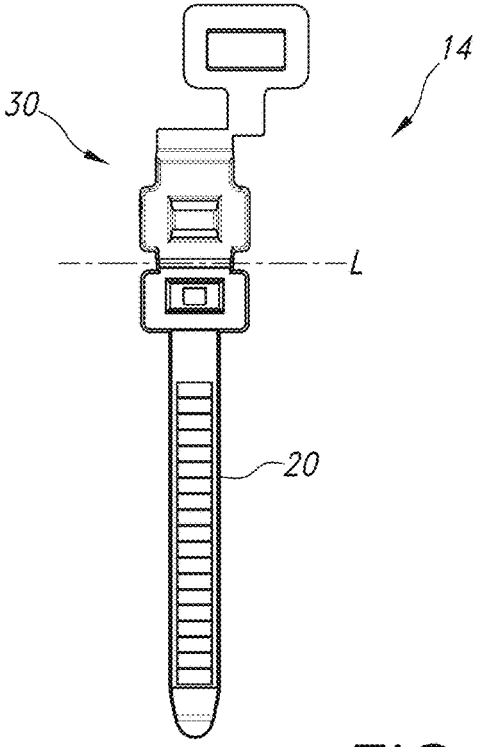
FIGS. 3A and 3B show the integrally molded product attachment assembly of the hanger assembly of FIG. 1.
Figure 3B:
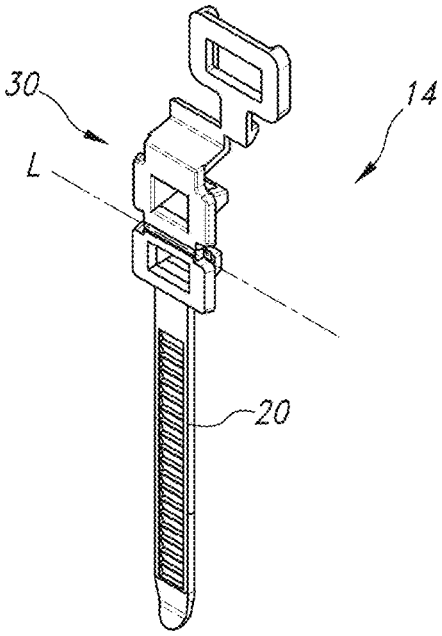

Referring now to FIGS. 3A and 3B, the integrally molded product attachment assembly 14 is shown. The attachment assembly 14 is molded from a suitable plastic. While being integrally molded, the product attachment assembly 14 has two distinct portions. The first portion is the product support member 20 which is the lower portion shown in FIGS. 3A and 3B. The product support member 20 is generally defined below the dotted lines L shown in FIGS. 3A and 3B. The product support member 20 is the portion that is different for each type of consumer product that is supported by the display hanger assembly 10.

For simplicity of description, only one product support member 20 is shown in detail. However, it can be appreciated that the lower portion of the integrally molded product attachment assembly 14 can include any of the product support members shown in FIGS. 1A-1G.

Integrally formed with the product support member 20 is the hook element attachment member 30 which is used to attach the integrally molded product attachment assembly 14 to the hook element. This portion is defined above the dotted lines L.

Referring now to FIGS. 4A, 4B, and 5A, 5B, the hook element attachment member 30 is shown in more detail. For clarity of description and understanding, the product support member 20 is not shown, but it may be appreciated that any of the product support members 20 shown in FIGS. 1A-1G would be integrally formed therewith. The hook element attachment member 30 includes two integrally connected portions, a first interconnecting portion 32, and a second interconnecting portion 34. While portions 32 and 34 are integrally molded, they are separable at a detachment web 36 therebetween.

Figure 4A:
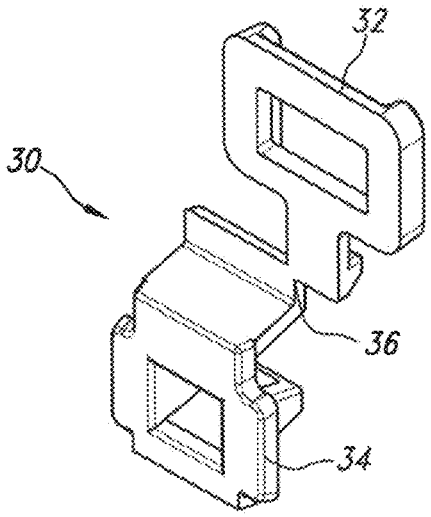
FIGS. 4A and 4B show the hook element attachment member of the integrally molded product attachment assembly of FIG. 1.
Figure 4B:
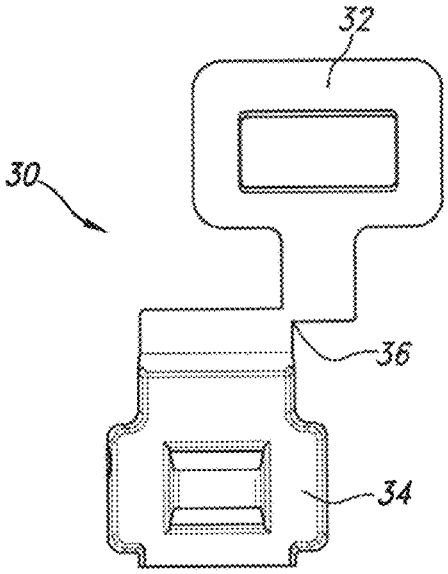
Figure 5A:
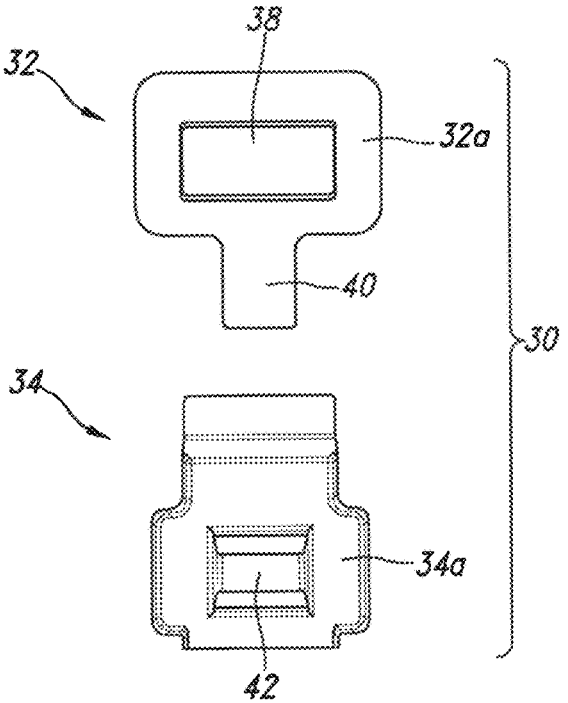
FIGS. 5A and 5B show the hook element attachment member in separated condition.
Figure 5B:
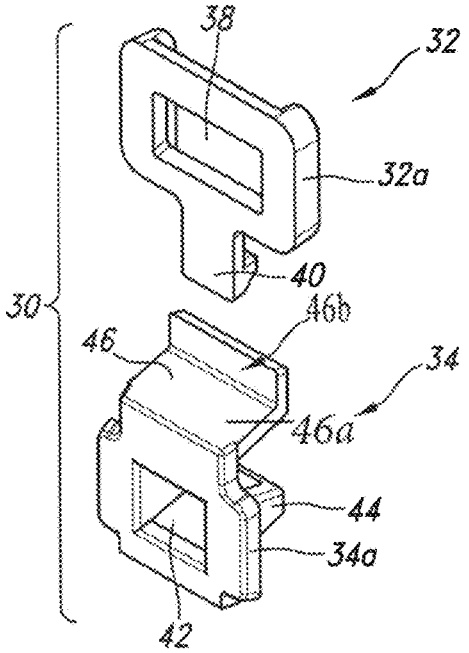

In FIGS. 4A and 4B, the interconnecting portions 32 and 34 are shown attached at web 36, whereas in FIGS. 5A and 5B, the interconnecting portions are shown detached.

Detachment of the first and second interconnecting portions may be achieved by a twisting and bending action to separate the parts at location 36. It is also contemplated that a suitable tool may be used.

Referring now to FIGS. 5A and 5B, the hook element attachment member 30 is shown in the detached condition.

First interconnecting portion 32 has a generally a rectangular planar body 32*a* having a central rectangular opening 38 therethrough. First interconnecting portion 32 also includes a hook 40 depending from body 32*a*, the purpose of which will be described in further detail hereinbelow.

Second interconnecting portion 34 is also has a generally planar rectangular body 34*a* having a central rectangular opening 42 therethrough. Extending around opening 42 is a U-shaped catch 44. The catch 44 extends outwardly from body 34*a*. Upwardly extending from the body 34*a* of second interconnecting portion 34 is an L-shaped extension 46. The extension 46 has first portion 46*a* extending outwardly and a second portion 46*b* extending upwardly from the distal edge of the first portion 46*a*. The opening 42, the catch 44 and the L-shaped extension 46 are designed to interconnect with components of the first interconnecting member 32 to secure the two components together to the hook element 12 through the opening 18 thereof as will described in further detail hereinbelow.

Figure 6A:
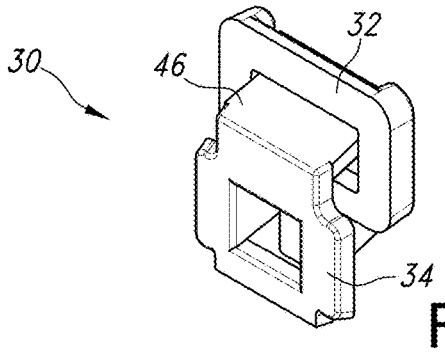
FIGS. 6A-6C show the hook element attachment member in assembled position.
Figure 6B:
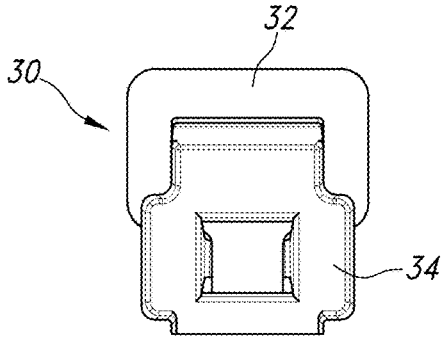
Figure 6C:
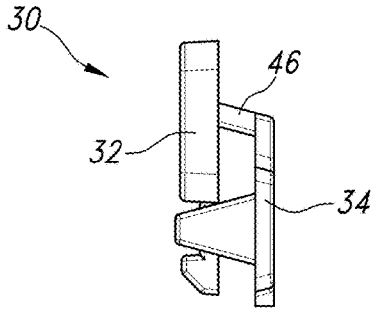
Figure 7A:
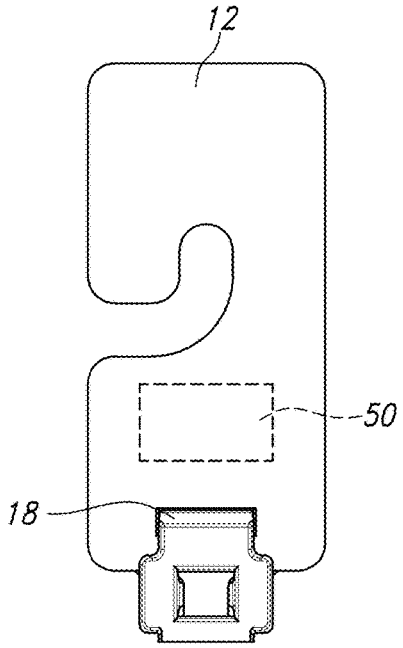
FIGS. 7A, 7B and 7C show the hook element attachment member assembled to the hook element.
Figure 7B:
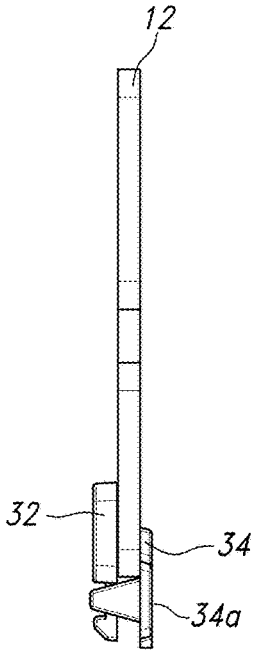
Figure 7C:
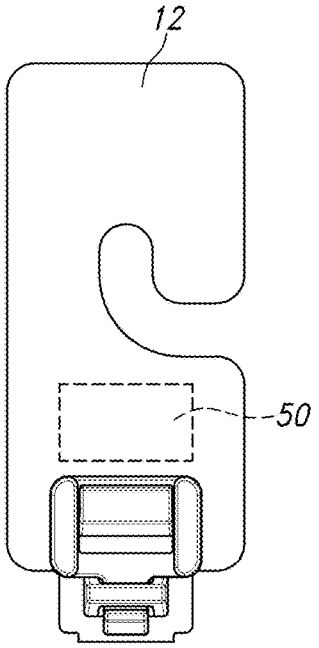

With additional reference to FIGS. 6A-6C and 7A-7C, the securement of the first interconnecting portion 32 to the second interconnecting portion 34 and to the hook element 12 may now be described. For clarity and ease of description, FIGS. 6A-6C show the two components interconnected apart from the hook element 12. It may be appreciated that the actual interconnection occurs as is shown in FIGS. 7A and 7B about the hook element 12.

When separated at web 36 as shown in FIGS. 5A and 5B, the hook element attachment member 30 is connected to hook element 12 by placing the L-shaped extension 46 of second interconnecting portion 34 through one side of passageway 18 so that the body 34*a* is on one side of the hook element 12 and the L-shaped extension 46 extends through to the other side. In this position, the catch 44 is below the bottom edge of hook element 12 also extending on the opposite side of hook element 12 from the body 34. Thereafter, the first interconnecting portion 32 is positioned on the other side of the hook element 12 so that the L-shaped extension 46 extends into rectangular opening 38 thereof. The depending hook 40 is inserted into the catch 44. Positioned this way, the first interconnecting element 32 is essentially locked to the second interconnecting portion 34. This arrangement is more clearly shown in FIGS. 6A-6C where the figures omit the hook element 12. However, the locking engagement of the hook element attachment member to the hook element is clearly shown in FIGS. 7A-7C.

Optionally, the display hanger assembly 10 may include an electronic article surveillance (EAS) tag 50 for theft deterrent purposes. One technique to provide an EAS tag is to embed the EAS tag 50 within the paperboard hook element 12. In this manner, the EAS tag is hidden and can function effectively as a theft deterrent.

It may be appreciated that the present invention provides for securement of product attachment assembly to the hook element in an identical manner regardless of the type of product support member 20 which is employed inasmuch as an identically constructed hook element attachment member is molded to the different product support members 20.

Various changes to the foregoing described and shown structures would now be evident to those skilled in the art. Accordingly, the particularly disclosed scope of the invention is set forth in the following claims.

What is claimed is:

1. A display hanger assembly for displaying and hanging a consumer product from a display rack comprising:

a hook element for hanging from a display rack peg;

an integrally molded product attachment assembly; said product attachment assembly including a product supporting member for supporting said consumer product at one end and a hook element attachment member for attaching the product attachment assembly to said hook element;

said hook element attachment member including a first interconnecting portion which is detachable from a second interconnecting portion so that the first and second interconnecting portions can be secured together about the hook element for securing said product attachment assembly to said hook element.

2. A display hanger assembly of claim 1 wherein said integrally molded product attachment assembly includes said hook element attachment member being integrally molded to one of a plurality of product support members.

3. A display hanger assembly of claim 1 wherein said hook element supports an electronic article surveillance (EAS) tag.

4. A display hanger assembly of claim 1 wherein said hook element includes a hook portion at one end and a hook element attachment member receiving portion at the other end.

5. A display hanger assembly of claim 4 wherein said hook element attachment member receiving portion includes an opening therethrough for securement of hook element attachment member.

6. A display hanger assembly of claim 5 wherein said first interconnecting portion has a planar body and a central opening therethrough.

7. A display hanger assembly of claim 6 wherein said second interconnecting portion has a planar body with a central opening therethrough and a U-shaped catch extending from said body and an L-shaped extension.

8. A display hanger assembly of claim 7 wherein the hook element attachment member is secured to the hook element with the L-shaped extension of the second interconnecting portion through a passageway of the hook element and through the opening in the first interconnecting portion.

9. A display hanger assembly of claim 8 wherein the second interconnecting member includes a catch and the first interconnecting portion includes a hook, in said second position the hook is inserted into the catch, locking the first interconnecting portion to the second interconnecting portion.

10. A display hanger assembly of claim 1 wherein said first interconnecting portion is manually detached from said second interconnecting portion.

* * * * *